United States Patent [19]

Graf

[11] 4,264,798

[45] * Apr. 28, 1981

[54] ELECTROSTATIC SWITCH

[76] Inventor: Ronald E. Graf, 9401 Union Pl., Gaithersburg, Md. 20760

[ * ] Notice: The portion of the term of this patent subsequent to May 4, 1993, has been disclaimed.

[21] Appl. No.: 51,153

[22] Filed: Jun. 22, 1979

Related U.S. Application Data

[62] Division of Ser. No. 648,571, Jan. 12, 1976, Pat. No. 4,160,141, which is a division of Ser. No. 502,224, Aug. 30, 1974, Pat. No. 3,955,059.

[51] Int. Cl.[3] ..... H01H 57/00

[52] U.S. Cl. ..... 200/181

[58] Field of Search ..... 200/181, 182, 214, 183, 200/221, 61.47, 193, 194, 222, 188, 33 A, 81.6; 137/251, 252, 253, 254; 350/267; 335/47, 58

[56] References Cited

U.S. PATENT DOCUMENTS

| | | | |
|---|---|---|---|
| 2,232,626 | 2/1941 | Olson | 200/33 A |
| 2,802,918 | 8/1957 | Boyle | 200/181 |
| 2,851,547 | 9/1958 | Hartz | 200/221 |
| 2,891,242 | 6/1959 | Lukoff | 350/267 |
| 2,929,889 | 3/1960 | Efther | 200/33 A |
| 3,222,469 | 12/1965 | Morris | 200/33 A |
| 3,249,724 | 5/1966 | Hurvitz | 200/181 |
| 3,548,857 | 12/1970 | Anderson | 137/251 |
| 3,632,941 | 1/1972 | Wasserman | 200/182 |
| 3,670,130 | 2/1970 | Greenwood | 200/181 |
| 3,973,092 | 8/1976 | Breed et al. | 200/221 |

FOREIGN PATENT DOCUMENTS

| | | | |
|---|---|---|---|
| 434414 | 10/1967 | Switzerland | 200/214 |

*Primary Examiner*—John W. Shepperd

[57] ABSTRACT

The indentations in a serrated wall are used as a temporary storage volume for a conducting liquid. A conducting layer in the serrated wall is separated from the conducting liquid by a thin dielectric layer. Electrostatic forces at selected times pull the liquid into the serrations. When the liquid later relaxes to a configuration touching the serrations only near the peaks it leaves the indented volume of the serrations, thus causing liquid movement at a liquid border elsewhere. This may result in extension beyond a chamber of a multichamber mercury switch. An added bonus is as follows. The reduced area of contact with the serrated wall in the relaxed liquid state can benefit a mercury switch, because the reduced area means a reduction in the amount of surface adhesion energy which must be overcome in removing a mercury globule from a chamber.

3 Claims, 8 Drawing Figures

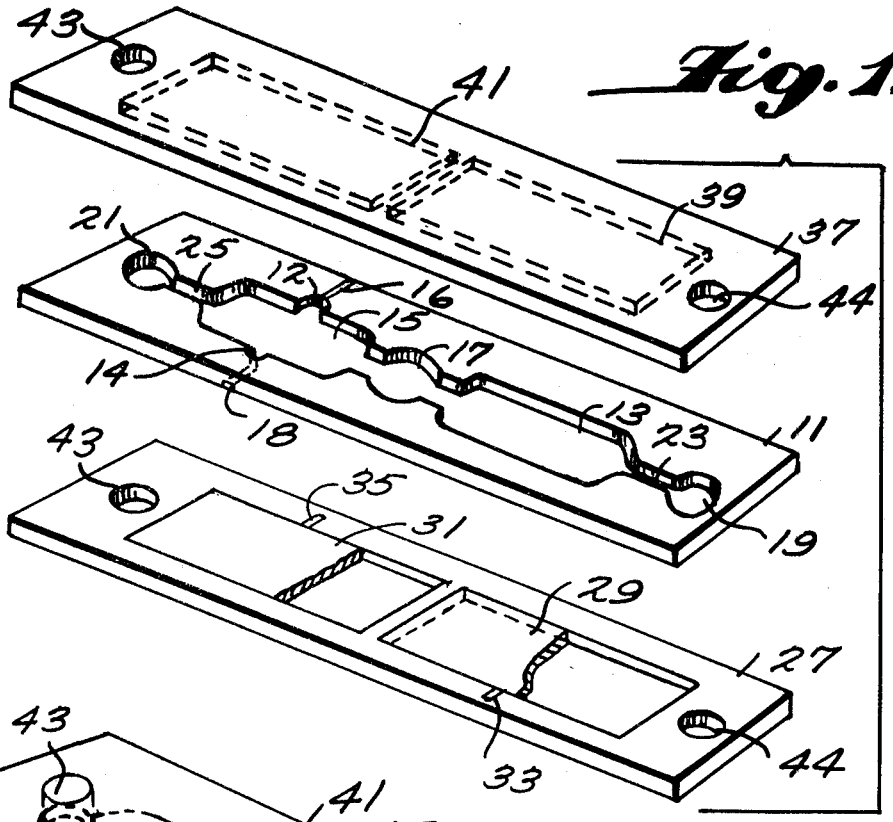
Fig. 1.
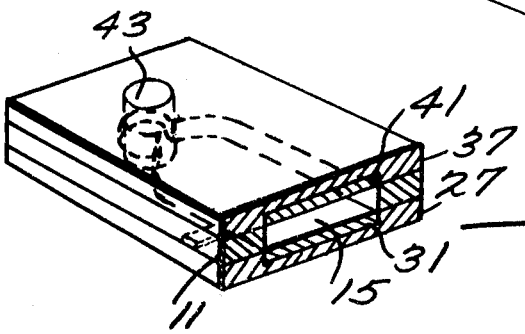
Fig. 1a.
Fig. 2.
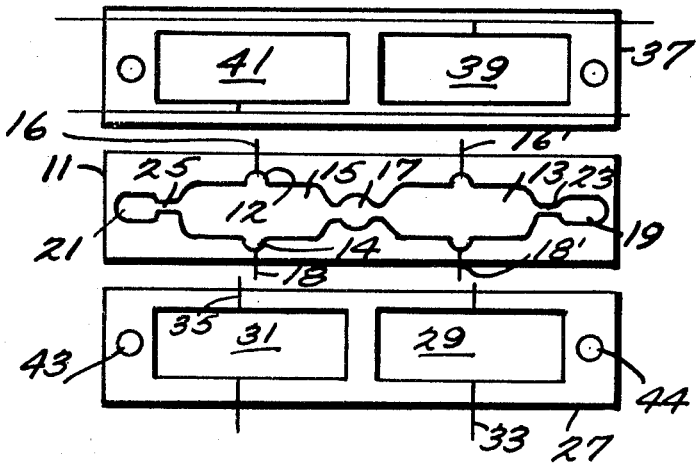

ELECTROSTATIC SWITCH

This application is a division of Ser. No. 648,571, filed Jan. 12, 1976 now issued as U.S. Pat. No. 4,160,141, which was a division of Ser. No. 502,224, filed Aug. 30, 1974 now issued as U.S. Pat. No. 3,955,059. U.S. Pat. No. 4,158,118 also started as a divisional application of Ser. No. 502,224.

BACKGROUND OF THE INVENTION

This invention relates to electrostatically operated switches for controlling electrical, fluidic or optical circuits.

The trend in the design of present day electronic circuits for use in systems such as telephone, computer and information handling systems is toward ever increasing application of integrated circuit technology which permits the employment of batch fabrication techniques in the manufacture of the switches. Thus, significant improvements have been achieved in reducing the size and cost of the logic control and processing circuitry for these systems. However, the switching devices which have been provided to date have been quite complex and have had less than adequate reliability. Accordingly, there is a need for a simple yet reliable electronic switching means which can be fabricated by integrated circuit techniques.

It therefore is an object of this invention to provide a simple but reliable electrostatically operated switch for controlling electrical, fluidic or optical circuits.

SHORT STATEMENT OF THE INVENTION

The use of a serrated surface as part of a liquid container is disclosed. An example is given in which a conductive liquid is contained in one chamber of a switch and can be moved to an adjoining chamber. In the absence of an electrostatic field the liquid remains in a configuration touching only near peaks of the serrations. In one version, electrically conducting layers exist each being respectively separated from each of two respective opposing serrated chamber walls by a respective thin dielectric layer. When a voltage is applied between opposing conducting layers the liquid is drawn further into the serrations of the chamber to which voltage is applied. When the voltage is later relaxed, the liquid substantially leaves the serration indentations to touch only at the peaks of the serrations. Thus the liquid effectively reenters the chamber from the serration indentations and can thus force some liquid to protrude from the chamber into a communicating region. In this region conducting layers from other chambers can affect the liquid.

As liquid leaves a chamber from which it is being switched, it travels touching only near the peaks of the serrations on that chamber wall, because voltage is not being applied across the chamber being vacated. It follows that surface adhesion effects are thus reduced in the chamber being evacuated, since only the peaks of the serrated surfaces are contacted. Less adhesion energy exists to be overcome in moving a liquid from a chamber.

BRIEF DESCRIPTION OF THE DRAWINGS

Other objects, features and advantages of the present invention will be more fully understood from the following detailed description, appended claims and the accompanying drawings in which:

FIG. 1 is an exploded perspective view of the electrostatic switch of the present invention, FIG. 1*a* is a partial perspective view of the electrostatic switch of the present invention, FIG. 2 is a planar view of components of the switch showing the electrical connections thereto.

DETAILED DESCRIPTION OF THE PREFERRED EMBODIMENT

Figure 3:
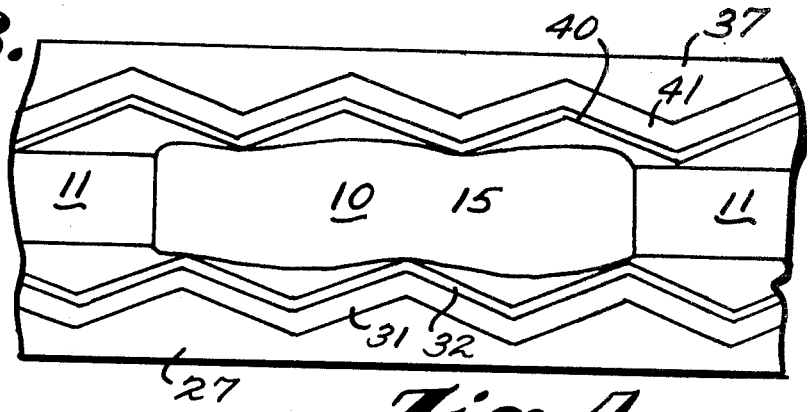
FIG. 3 is a cross-sectional view of the electrostatic switch wherein the conductive plates defining the top and bottom of the chambers are serrated.

Refer now to FIGS. 1 and 1*a* where there is disclosed a first embodiment of the present invention. A first dielectric plate 11 which is of a relatively thin elongated structure has a first and second chamber 13 and 15, respectively, formed therein, which chambers are connected by means of a constricted region 17. At the other end of each of the chambers is a through-hole 19 and 21, respectively, which through-holes are connected to the associated chambers 13 and 15, respectively, by means of channels 23 and 25, respectively.

Cavities 12 and 14 are formed on opposite sides of at least one of the chambers, as illustrated, in order to entrap a conductive liquid therein. A conductor 16 is plated by known techniques onto the plate 11 such that the conductive material, e.g., copper, extends from the outside edge of the plate 11 to the cavity 12 and then extends downwardly along the wall of the cavity in a vertical direction to ensure a good electrical contact with the conductive liquid which is entrapped in the cavity. On the opposite side of the chamber a conductive layer 18 is plated by known techniques on the underside of the plate 11 such that the conductor extends from a position remote from the chamber 15 to the cavity 14 and then upwardly along the wall of the cavity, as illustrated in dotted lines. While the conductor is shown as plated onto the plate 11 in the preferred embodiment, it should be understood that the conductor could be in the form of a wire which projects into the cavities 12 and 14.

Positioned below plate 11 is a substrate plate 27 which plate is formed of a dielectric material. Electrode plates 29 and 31 are formed on the surface of the dielectric substrate 27 by one of several known means, such as, for example, sputtering, spraying, painting, etc. These electrodes are connected to electric lines 33 and 35 which may be formed on the substrate 27 by means of sputtering, spraying, etc. A very thin dielectric coating (not shown) is placed or deposited over the conductive plates and a thicker coating (not shown) is placed over the conductive lines. The dielectric coating on the plates may be an oxide layer formed by anodizing the metal of the conductive plates. In one alternative the coating on the lines may be simply another laminar layer. The substrate 27 is secured to the bottom side of dielectric plate 11 by any suitable technique known in the art.

An upper dielectric substrate 37 is provided having a structure similar to that of substrate 27 and has a pair of electrode plates 39 and 41 deposited on the underside thereof in a manner similar to the conductive plates 29 and 31. In addition, connecting lines (not shown) are deposited on the substrate which extend from the conductive plates to the edge of the dielectric substrate. These lines can be formed on the surface of the dielectric by any one of several means known in the art. In the alternative, it should be understood that the lines which extend from the conductive plates could be extended through the dielectric substrates 27 and 37 in a direction perpendicular to the plane thereof. The dielectric substrate 37 is placed over the top of dielectric plate 11 and secured thereto to form a composite switch such as illustrated in partial section in FIG. 1*a*. As illustrated in FIG. 1*a*, the chamber 15 formed in the dielectric plate 11 is bordered on the top and bottom thereof by the conductive plates 41 and 31, respectively. A conductive liquid, such as mercury, is introduced into the chamber 15 via a hole 43 which is aligned with the through-hole 21 in the dielectric plate 11. If, for example, a plurality of the switches of the present invention are stacked one on top of another, the through-holes 21 and the holes 43 to the dielectric substrates are aligned with one another so that mercury or other conductive fluid can be introduced to a plurality of chambers 15 simultaneously. After the conductive fluid is introduced into the chamber in the plate 11, the hole 43 is sealed either permanently or temporarily. At the same time the through hole 44 at the opposite end of the switch is also sealed. The purpose for having the hole 44 is to permit gas to escape from the chambers as the mercury is introduced therein. If the holes 43 and 44 are temporarily sealed, such as by a meltable solder, wax or other material or by the insertion of a rod therethrough, the chambers 13 and 15 can from time to time be flushed out, cleaned, reanodized and then refilled with the conductive liquid. Thus a serviceable electrostatic switch is provided which can be easily maintained with age. The sealing will prevent evaporation as well as escape of the conductive liquid. The surfaces of plates 37, 27, and 11 of FIGS. 1 and 1*a* may be flat or undulating. The undulations can correspond to the shape and constrictions in plate 11, thus enhancing the effect of the constrictions. The undulations could actually replace the constrictions and canals.

Refer now to FIG. 2 where there is illustrated a schematic planar view of each of the layers which comprise the switch. The dielectric plate 11 is shown having chambers 13 and 15 formed therein which chambers are separated by a constriction 17. At the opposite ends of each of the chambers 13 and 15 are formed through-holes 19 and 21, respectively, which holes are separated from the chambers by means of channels 23 and 25. Cavities 12 and 14 are formed in the chamber 15 for providing a recessed area into which the conductors 16 and 18 enter the chamber. These cavities have a tendency to retain the liquid conductor therein even when the liquid conductor moves from chamber 15 to chamber 13. Thus, the exposed portion of the conductors 16 and 18 remains wetted so as to provide a good electrical contact between the liquid conductor and the metal conductors 16 and 18. If conductive leads are extended to chamber 13, cavities of similar design are provided at the sides thereof, as illustrated, for the purpose of insuring a good electrical contact between the conductors which extend into the chamber and the liquid conductor which electrically connects the conductors to one another.

Positioned under layer 11 is a dielectric substrate 27 which has holes 43 and 44 therethrough at the respective ends thereof. In addition, conductive plates 29 and 31 are positioned on the dielectric substrate 27, as aforementioned, with a very thin insulating layer positioned over the top thereof. A conductive lead extends to the conductive plate 29 and a second conductive lead 35 extends to the conductive plate 31. Positioned on top of the layer 11 is a second dielectric substrate 37 having a pair of conductive plates 39 and 41 plated thereon, which plates appear opposite the plates 29 and 31, respectively, when dielectric substrate 37 is folded over on top of layer 11. As aforementioned, each of the conductive plates 39 and 41 has a very thin dielectric layer formed over the top thereof in order to insulate plates 39 and 41 from the conductive liquid within the chambers 13 and 15. The substrates 27 and 37 sandwich the layer 11 as illustrated in FIG. 1*a* to form a composite electrostatically operated switch.

In operation after a conductive liquid, such as mercury, has been injected into one of the chambers 13 or 15 via aligned holes 43 and 21 or 44 and 19, the holes are sealed. Assuming that a dielectric liquid is initially positioned in chamber 15, a voltage is established across plates 29 and 39, thereby attracting the conductive liquid from chamber 15 to chamber 13. When the conductive liquid has entered the chamber 13, the current passing from conductor 16 through the liquid in chamber 15 to the conductor 18 will be cut off. If a two-way switch is desired, conductive leads can extend into chamber 13 in which case lead 16' is electrically connected to lead 18' via the conductive liquid.

Figure 4:
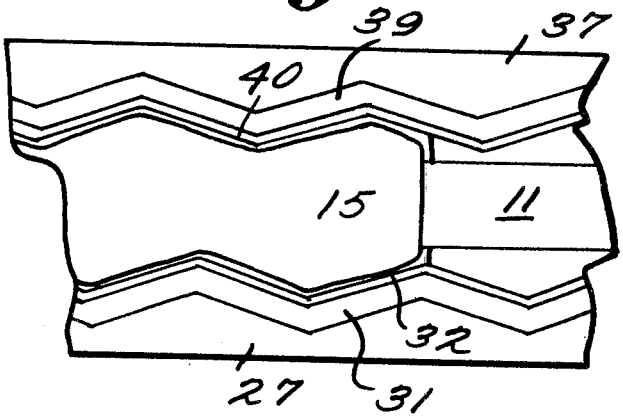
FIG. 4 is a cross-sectional view of the electrostatic switch of the present invention showing the conductive liquid therein after a voltage has been applied to the conductive plates which define the top and bottom of the chamber.

Refer now to FIGS. 3 and 4 which are cross-sectional views of the electrostatic switch of the present invention showing the conductive plates as being of a serrated configuration. The central dielectric layer 11 is illustrated defining a chamber 15 which contains the liquid conductive material. The lower substrate 27 is serrated in the form of a saw-tooth waveform with a layer of a conductive material 31 deposited thereon by techniques known in the art. The peaks should be rounded to avoid large electric fields. Over the top of the conductive layer 31 is positioned a relatively thin dielectric material 32 such as might be provided by anodizing the conductive plate 31. Above the layer 11 and the conductive liquid 10 is positioned the upper dielectric substrate 37, also having a conductive layer 41 deposited thereon with a dielectric layer 40 which is very thinly formed on top of the plate 41 to thereby insulate the plate 41 from the conductive liquid 10. As illustrated in FIG. 3, no voltage is applied across the plates 41 and 31 and accordingly, the surface tension of the conductive liquid 10 forms the conductive liquid into a generally rectangular shape.

With specific reference to FIG. 4, a voltage is applied across the conductive liquid 10 and it can be seen that the conductive liquid is drawn into the serrations of the switch formed by the conductive plates 31 and 41 and their dielectric layers 27 and 37, respectively. In this configuration, the conductive liquid is drawn away from the constriction 17, illustrated in FIGS. 1 and 2, in order to make a solid electrical contact between the conductive elements 16 and 18 extending into the opposite sides of the chamber 15.

Figure 5:
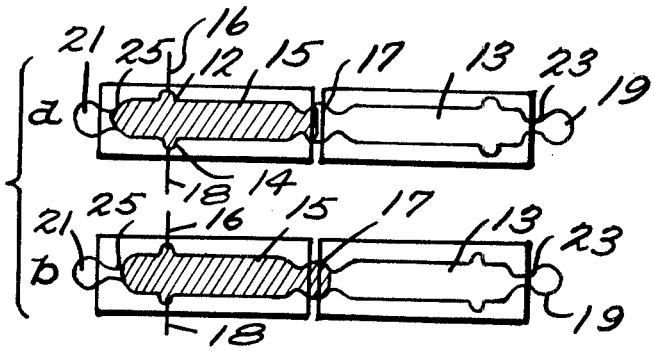
FIG. 5 is a schematic planar view illustrating the effect of applying a voltage across one chamber of the switch.
Figure 6:
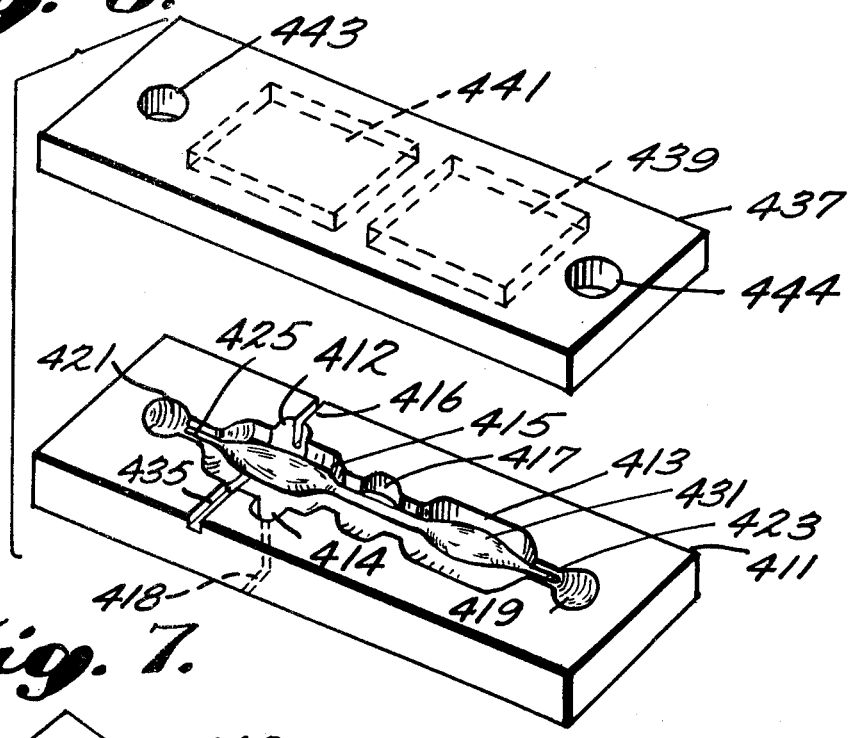
FIG. 6 is an exploded perspective view of an alternative embodiment of the electrostatic switch of the present invention.
Figure 7:
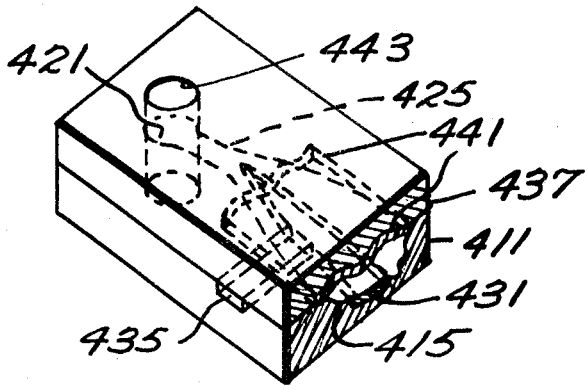
FIG. 7 is a partial perspective view of the switch of FIG. 6.

Refer now to FIG. 5 where there is disclosed a schematic illustration of the electrostatic switch of the present invention wherein the upper and lower conductors bordering the chambers 13 and 15 are formed with serrations therein, as illustrated in FIGS. 3 and 4. In FIG. 5*a* there is shown the condition of the conductive liquid positioned within chamber 15 when a voltage is applied across the conductive plates which border the top and bottom of the chamber 15. As illustrated, the conductive liquid is positioned within the cavities 12 and 14 and chamber 15 and is drawn inwardly from the constricted area 17 so that in general the liquid does not extend under the conductive plates which border the chamber 13. Referring to FIG. 5*b*, when the voltage across the conductive plates which border the chamber 15 is inhibited, the conductive liquid relaxes, as illustrated in FIG. 3, so that the liquid substantially fills the constricted area 17. In this arrangement, the liquid thus extends under the conductive plates which define the top and bottom of the chamber 13 so that when a voltage is applied to these conductive plates, the conductive liquid is drawn from chamber 15 into chamber 13 to thereby open the electrical circuit between conductive elements 16 and 18.

The liquid actions depicted in FIG. 5 may seem unnecessary until one considers methods for filling substantially one chamber with liquid after the switch is closed. It would be possible to do the filling independent of serrations if all chambers have the same dimensions and fluid metering is used. However, in the present invention exact mechanical tolerances can be waived and switches can be stacked in more than one layer before filling.

What is claimed is:

1. A device comprising a solid composed container for containing liquid, a liquid partially filling said container, serrations formed in at least a special portion of container wall, to be referred to as a control portion, an electrically conducting layer separated from said special portion of container wall by a thin dielectric layer, means in cooperation with said conducting layer to apply an electrostatic field to said liquid in response to an applied voltage, said serrations in said control portion being shaped and said field being effective and said liquid interacting with the surface of said control portion and said field to produce configurations such that whenever said liquid is adjacent to said control portion and said electrostatic field is applied sufficiently then said liquid is pulled further into the indentations between the peaks of said serrations in said control portion after equilibrium is attained than when the liquid is adjacent to said control portion and no said electrostatic field has been applied for a time long enough to obtain equilibrium, and such that whenever said electrostatic field, having drawn liquid at least partially into said indentations in said control portion, is removed for a sufficient time then said liquid pulls back out from said indentations to touch the serrations only near their peaks, the pulling out being caused at least in part by surface tension potential energy effects of said liquid.

2. A device as in claim 1 wherein the described liquid movement into and out from said indentations in said control portion is used to cause the border of said liquid to move at places other than in the immediate neighborhood of said control portion.

3. A device as in claim 1 wherein whenever said liquid pulls back out from said indentations in said control portion said liquid becomes adjacent to a portion of container wall to which it was not adjacent immediately prior to pulling back out from said indentations.

* * * * *